United States Patent [19]

Alden

[11] Patent Number: 4,538,560

[45] Date of Patent: Sep. 3, 1985

[54] INTERNAL COMBUSTION ENGINE VALVE COVER

[76] Inventor: Lawrence S. Alden, 2504 Flower Rd., Venice, Fla. 33595

[21] Appl. No.: 615,164

[22] Filed: May 30, 1984

[51] Int. Cl.[3] ..... F01M 9/10

[52] U.S. Cl. ..... 123/90.38; 123/193 H; 123/195 C

[58] Field of Search ..... 123/193 R, 193 U, 195 R, 123/195 C, 90.38, 90.37

[56] References Cited

U.S. PATENT DOCUMENTS

| | | | |
|---|---|---|---|
| Re. 30,253 | 4/1980 | Haldeman et al. | 123/193 C |
| D. 244,760 | 6/1977 | Phillips | D19/62 |
| 2,269,035 | 1/1942 | Neal | 434/370 |
| 4,027,644 | 6/1977 | Timour | 123/90.38 |
| 4,195,478 | 4/1980 | Rao et al. | 123/193 H |
| 4,388,898 | 6/1983 | Larson | 123/90.38 |

FOREIGN PATENT DOCUMENTS

| | | | |
|---|---|---|---|
| 1066415 | 6/1954 | France | 123/90.38 |

*Primary Examiner*—Craig R. Feinberg
*Attorney, Agent, or Firm*—Hauke and Patalidis

[57] ABSTRACT

An improved internal combustion engine valve cover comprises a stamped metal, frusto-pyramidal main body portion having a bottom perforated flange, grooved upwardly tapering sides, and a planar top having an aperture therein. A clear synthetic "window" of plastic material is bolted to the top covering the aperture, and a suitable sealant is disposed between the "window" material and the metal top.

The perforated flange has a dependent lip around its peripheral edge and the grooves in the tapered sides are associated with respective perforations in the flange.

3 Claims, 3 Drawing Figures

INTERNAL COMBUSTION ENGINE VALVE COVER

BACKGROUND OF THE INVENTION

1. Field of the Invention

The present invention relates generally to internal combustion engines of the type used in motor vehicles, and it is more particularly related to valve covers over the rocker arms that actuate the valves in the internal combustion engine installed in such motor vehicles.

2. Prior Art

Motor vehicles that are put on display at automobile shows and other exhibitions, in many instances, have engines that are equipped with accessories that are chrome plated to attract attention and to enhance the worth of the automobile itself.

In the prior art there are metal valve covers that over-lie and conceal the rocker arms that actuate the valves of an engine in such a motor vehicle. There are valve covers in the prior art that are made of clear plastic so that one may observe the rocker arms either at rest or in motion when the engine is operating.

However, such plastic valve covers tend to crack after a short period of use due to the heat generated by the engine and due to the tightening and retightening of the bolts holding the valve cover to the engine block.

In contrast to such plastic valve covers, my improved valve cover is a chrome plated metal body portion with a clear plastic window in the top portion of the body. The metal body does not crack and the clear plastic window will not crack, yet it allows one to observe the rocker arms at rest or in motion.

Further, my improved valve cover is able to withstand the heat generated by the engine, and the forces imposed thereon by using a torque wrench to tighten and retighten the hold down bolts that secure the cover to the engine block. It is well known that from time to time the valve covers must be removed to adjust the valves of the engine and the constant tightening and retightening of the hold down bolts imposes a great strain on a valve cover. But, my improved valve cover, being of metal, can resist these forces and maintain its integrity for long periods of time without leaking lubricating oil.

SUMMARY OF THE INVENTION

An improved internal combustion engine valve cover comprises a frusto-pyramidal main body portion having a peripheral flange at the bottom and a planar top having an aperture therein. A clear synthetic plastic closure for the aperture is disposed thereover and secured to the main body portion by bolt and nut assemblies. The flange is perforated and the sides of the main body portion are grooves to accommodate hold down bolts passing through the perforations in the flange.

For a further understanding of the invention and for features and advantages thereof, reference may be made to the following description of one embodiment of the invention taken in conjunction with the drawing thereof.

DETAILED DESCRIPTION OF THE PREFERRED EMBODIMENTS

Figure 1:
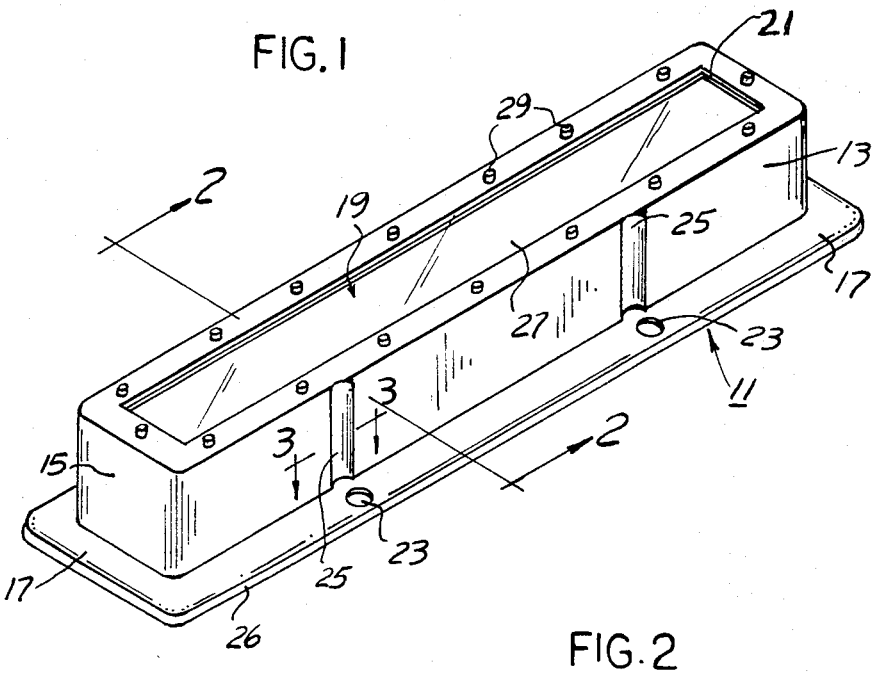
FIG. 1 is a schematic view in perspective of my improved internal combustion engine valve cover.

Referring to FIG. 1, an improved internal combustion engine valve cover 11, in accordance with the invention, comprises a main body portion 13 which is fabricated, preferably, by stamping it from a sheet of metal. The main body portion 13 includes a rectangular frusto-pyramidal portion 15 and a flange 17 around the bottom edge of the main body portion 13. The top 19 of the main body portion 13 is planar and has a rectangular opening 21 therein.

Figure 2:
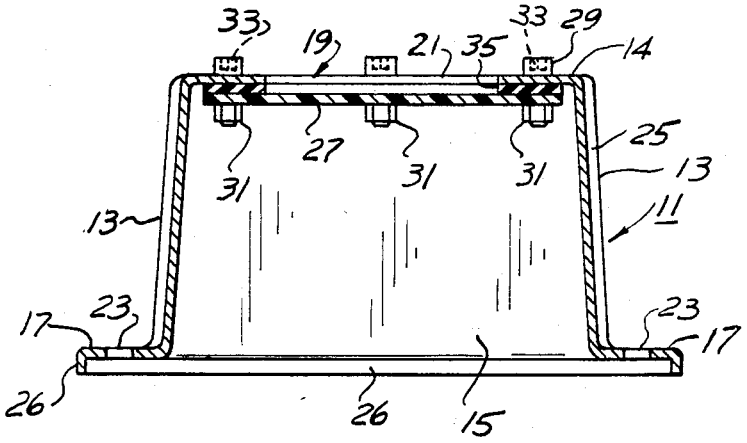
FIG. 2 is a sectional view along line 2—2 of FIG. 1.
Figure 3:
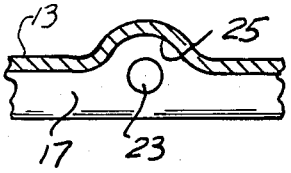
FIG. 3 is a sectional view along line 3—3 of FIG. 1.

The flange 17 has a plurality of holes 23 therein and the sides of the main body portion 13 have a plurality of grooves 25; each groove 25 being associated with a respective hole 23. The holes 23 receive conventional hold down bolts (not shown) to secure the valve cover 11 to the engine block. As shown in FIG. 2, the outer peripheral edge of the flange 17 has a down-turned lip 26 that tends to hold a head gasket on the engine block from exuding when the hold down bolts are tightened. Also, the down-turned lip 26 enhances the edge appearance of the cover.

The rectangular opening 21 in the planar top is closed by a clear plastic closure member or window 27 that is secured to the cover by a plurality of nut and bolt assemblies. The bolts 29 and the nuts 31 are disposed with the nuts 31 inside the valve cover 11, and the bolt heads have a socket for receiving an Allen socket wrench; the sockets being numbered 33 on the drawing. However, the bolts may be of any other type that match the valve cover hold down bolts, if preferred. One material that has been found to be satisfactory for a closure to the opening in the top 19 is LEXAN®, a product of The General Electric Company.

Between the plastic closure or window 27 and the cover 11, there is a suitable gasket 35 that resists heat and, preferably, is impervious to lubricating oil. One suitable gasket material is silicone, but those silicone in the art will recognize other suitable gasket material, such as oilized paper or cork, or the like.

The improved internal combustion engine valve cover 11 may be chrome plated which brightens the appearance of the engine generally. Thereafter, when the engine is on display or running, one may observe the rocker arms through the window as they actuate the valves of the engine.

From the foregoing description of one embodiment of the invention, shown in the drawing, those skilled in the art will recognize many significant features and advantages of the present invention, among which are:

That the rocker arms, the valve springs and the push rods of an internal combustion engine fitted with the valve cover of the invention are clearly visible through the window in the cover;

That the valve cover has a bright appearance that is attractive and that enhances the overall appearance of a display-type of internal combustion engine;

That the valve cover may, for racing motor vehicle engines, have additional height to provide clearance for the rocker arms in such engines; and That the all metal main body portion of the valve cover eliminates the cracking problem of plastic valve covers known in the prior art.

Although the invention has been described in relation to one embodiment thereof, it is understood that other modifications may be made therein without departing from the spirit thereof and the scope of the appended claims.

I claim:

1. An improved internal combustion engine valve cover comprising a metal main body portion having a generally rectangular form with sides that slope upwardly and inwardly from a planar outwardly extending bottom flange and that merge with a planar top having a coaxial generally rectangular aperture formed therein with edges thereof parallel and generally equally spaced from the sides of said form exposing substantially all of an interior of said cover, a generally rectangular corresponding oriented clear plastic window over said aperture that is secured inside said cover to said top by removable fasteners, a down-turned lip on the peripheral edge of said flange, a plurality of perforations in said flange, a plurality of grooves in the sides of said main body portion said grooves being associated with respective perforations in said flange, and means for sealing said plastic window to said top.

2. The valve cover of claim 1 wherein said removable fasteners include Allen head bolts and nuts threaded thereon.

3. The valve cover of claim 1 wherein said sealing means includes a silicone preparation applied to said metal top and to said window.

* * * * *

UNITED STATES PATENT AND TRADEMARK OFFICE

CERTIFICATE OF CORRECTION

PATENT NO. : 4,538,560

DATED : September 3, 1985

INVENTOR(S) : Lawrence S. Alden

It is certified that error appears in the above-identified patent and that said Letters Patent is hereby corrected as shown below:

Column 2, line 43, change "silicone" (second occurrence) to --skilled--.

Signed and Sealed this

*Third* Day of *December 1985*

[SEAL]

*Attest:*

DONALD J. QUIGG

*Attesting Officer*

*Commissioner of Patents and Trademarks*